US007044750B1

(12) United States Patent
Lin

(10) Patent No.: US 7,044,750 B1
(45) Date of Patent: May 16, 2006

(54) NETWORK CONNECTOR

(75) Inventor: Hung-Chao Lin, Taipei (TW)

(73) Assignee: U.D. Electronic Corp., Taoyuan Hsien (TW)

( * ) Notice: Subject to any disclaimer, the term of this patent is extended or adjusted under 35 U.S.C. 154(b) by 0 days.

(21) Appl. No.: 11/160,826

(22) Filed: Jul. 12, 2005

(51) Int. Cl.
*H01R 12/00* (2006.01)

(52) U.S. Cl. ..... 439/76.1; 439/620

(58) Field of Classification Search ..... 439/76.1, 439/620
See application file for complete search history.

(56) References Cited

U.S. PATENT DOCUMENTS 6,468,092 B1 * 10/2002 Graff et al. ..... 439/76.1
6,537,110 B1 * 3/2003 Korsunsky et al. ..... 439/676
6,568,966 B1 * 5/2003 Korsunsky et al. ..... 439/676
6,641,440 B1 * 11/2003 Hyland et al. ..... 439/620
6,663,437 B1 * 12/2003 Korsunsky et al. ..... 439/676
6,752,664 B1 * 6/2004 Hyland et al. ..... 439/620
6,761,595 B1 * 7/2004 Zheng et al. ..... 439/676
6,848,943 B1 * 2/2005 Machado et al. ..... 439/607
6,881,096 B1 * 4/2005 Brown et al. ..... 439/620
6,902,433 B1 * 6/2005 Hashimoto et al. ..... 439/620
6,929,487 B1 * 8/2005 Raghavendra et al. ..... 439/76.1
6,976,877 B1 * 12/2005 Lien ..... 439/620
2003/0194908 A1 * 10/2003 Brown et al. ..... 439/620
2004/0014362 A1 * 1/2004 Slack et al. ..... 439/620
2004/0082223 A1 * 4/2004 Hyland et al. ..... 439/620
2005/0070162 A1 * 3/2005 Espenshade et al. ..... 439/620
2005/0106941 A1 * 5/2005 Witchey ..... 439/620

* cited by examiner

*Primary Examiner*—Ross Gushi

(57) ABSTRACT

A network connector is disclosed to electrically insulative include housing, which holds terminals bonded to an external circuit board, an adapter circuit board, which has curved adapter terminals suspending in an adapter slot in the housing and contact holes, a filter module, which has rear terminals respectively connected to the contact holes of the adapter circuit board and front terminals, and a control circuit module, which has front contact holes and rear contact holes respectively connected to the front terminals of the filter module and the terminals of the housing.

19 Claims, 7 Drawing Sheets

NETWORK CONNECTOR

BACKGROUND OF THE INVENTION

1. Field of the Invention

The present invention relates to an electric connector and more particularly, to a network connector, which has incorporated therein a control circuit module and a filter module to simultaneously perform signal processing and filtering works, and uses a zigzag transmission route for signal transmission to reduce the dimensions of the whole assembly.

2. Description of the Related Art

Following fast development of computer technology, desktop and mobile computers have become popular everywhere in the society. It is the computer market tendency toward the characteristics of sophisticated function, high operation speed, and small size. Further, current network communication technology has been rapidly developed, bringing our living, learning, working and entertainment to a new field. Under this new information era, people frequently communicate each other through the Internet to transmit the desired real-time information, advertisement or e-mail. Through the Internet, we can search the desired information, talk to each other or one another on the line, or play on-line games. Many people cannot work without the Internet. The demand for network communication is more and more heavy. Further, when connecting a computer to an external network, a network connector must be used. Regular network connectors, such as RJ45 connectors and the like, commonly adopt digital communication. Following the market tendency toward light, thin, short and small characteristics, computer internal space has been greatly reduced, and signal interference problem may follow. This signal interference problem may occur due to the presence of surrounding electromagnetic interference or connector internal interference. A network connector may produce a high-frequency wave that interferes with external electric devices. The connector signal may also be easily interfered by the noises produced in the surrounding transmission lines. Therefore, connector manufacturers commonly cover the network connector with a metal shielding shell to protect against electromagnetic interference and install a filter module in the network connector to filter noises from the signal, for enabling the network signal to be transmitted to an external control circuit interface (for example, PCI-Express interface), so that the network signal can be converted into a series data transmission signal for further processing by a data processing system.

However, according to conventional designs, a network connector and the corresponding control circuit interface are separately prepared and then respectively installed in the computer. This separated design requires much computer inside space, and complicates the installation procedure.

Therefore, it is desirable to provide a network connector that eliminates the aforesaid problems.

SUMMARY OF THE INVENTION

The present invention has been accomplished under the circumstances in view. It is therefore the main object of the present invention to provide a network connector, which has incorporated therein a control circuit module and a filter module to simultaneously perform signal processing and filtering works, and uses a zigzag transmission route for signal transmission to reduce the dimensions of the whole assembly. It is another object of the present invention to provide a network connector, which is easy and inexpensive to manufacture. It is still another object of the present invention to provide a network connector, which provides a satisfactory EMI (electromagnetic interference) protective effect. To achieve these and other objects of the present invention, the network connector comprises an electrically insulative housing, the electrically insulative housing comprising an accommodating chamber, a base disposed at one side of the accommodating chamber, the base having a plurality of through holes, a plurality of terminals respectively mounted in the through holes of the base and bonded to an external circuit board, a adapter slot disposed at one side of the accommodating chamber opposite to the base and adapted to receive a connector from a network; an adapter circuit board mounted in the accommodating chamber inside the electrically insulative housing, the adapter circuit board comprising a plurality of curved adapter terminals respectively suspending in the adapter slot of the electrically insulative housing; a filter module; and a control circuit module; wherein the adapter circuit board comprises a plurality of contact holes near a rear side thereof; the filter module comprises a plurality of rear contact holes respectively electrically connected to the contact holes of the adapter circuit board and a plurality of front contact holes; the control circuit module comprises a plurality of front contact holes respectively electrically connected to the front contact holes of the filter module and a plurality of rear contact holes respectively electrically connected to the terminals of the electrically insulative housing. Further, a metal shielding shell surrounds the electrically insulative housing to protect against EMI.

DETAILED DESCRIPTION OF THE PREFERRED EMBODIMENT

Figure 1:
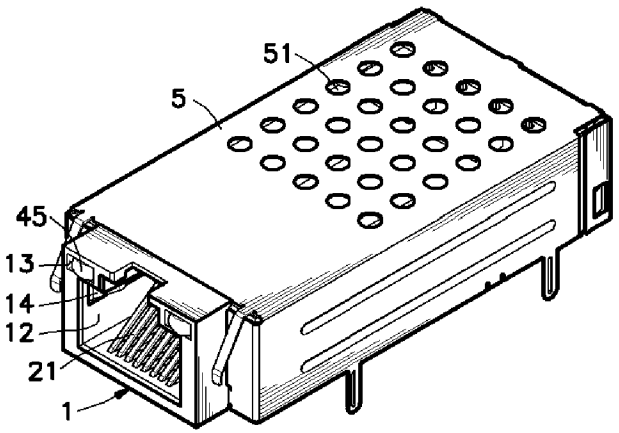
FIG. 1 is an elevational view of a network connector according to the present invention.
Figure 2:
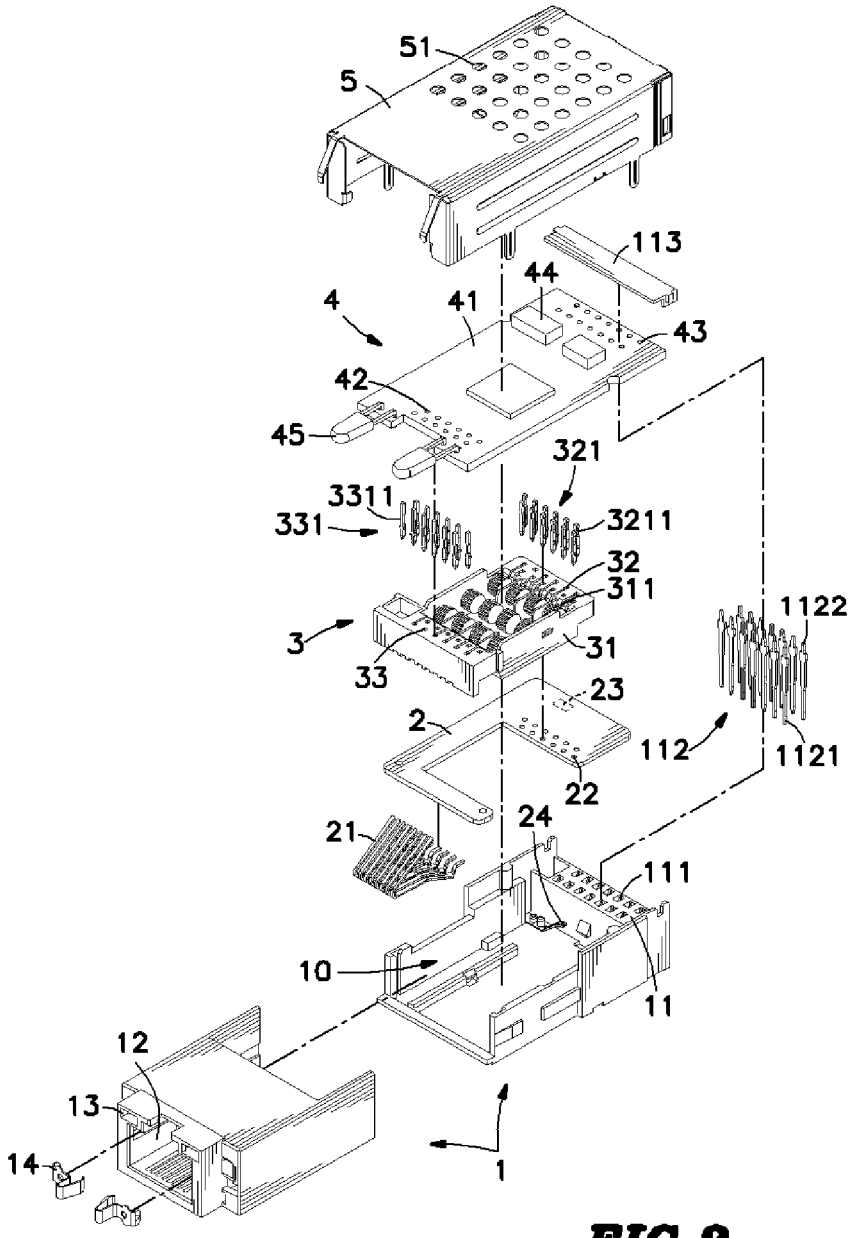
FIG. 2 is an exploded view of the network connector according to the present invention.

Referring to FIGS. 1 and 2, a network connector in accordance with the present invention is shown comprised of an electrically insulative housing 1, an adapter circuit board 2, a filter module 3, and a control circuit module 4.

The housing 1 is a hollow member defining an accommodating chamber 10 adapted to accommodate the adapter circuit board 2, the filter module 3 and the control circuit module 4. The housing 1 has a base 11 at one side. The base 11 has a plurality of through holes 111. Terminals 112 are respectively mounted in the through holes 111 of the base 11, each having a bonding end 1121 extending out of the bottom side of the base 111 for bonding to an external circuit board (not shown) and a contact end 1122 extending out of the top side of the base 11. A cover plate 113 is provided above the contact ends 1122 of the terminals 112. A adapter slot 12 is provided at a remote side opposite to the accommodating chamber 10, and two front lamp holes 13 adjacent to the adapter slot 12. Two metal grounding spring plates 14 are bilaterally mounted in the adapter slot 12.

The adapter circuit board 2 is mounted in the accommodating chamber 10 of the housing 1, having a plurality of curved adapter terminals 21 arranged at the front side thereof and suspending in the connector slot 12 of the housing 1, a plurality of contact holes 22 arranged near the rear side thereof, and a bottom grounding contact 23. Further, a grounding terminal 24 is installed in the accommodating chamber 10 of the housing 1 and fastened to the base 11 for the contact of the bottom grounding contact 23.

The filter module 3 is mounted in the accommodating chamber 10 of the housing 1 at one side (the top side) of the adapter circuit board 2, comprising a filter holder 31, a filter circuit 311 comprised of resistors, capacitors and filters and mounted in the filter holder 31, a plurality of rear contact holes 32 arranged near the rear side, a plurality of front contact holes 33 arranged near the front side, a plurality of rear terminals 321 respectively mounted in the rear contact holes 32, and a plurality of front terminals 331 respectively mounted in the front contact holes 33. The rear terminals 321 each have a neck 3211 respectively fastened to rear-side coils (not shown) of the filter circuit 311. The front terminals 331 each have a neck 3311 respectively fastened to front-side coils (not shown) of the filter circuit 311.

The control circuit module 4 is mounted in the accommodating chamber 10 of the housing 1 at one side (the top side) of the filter module 3 opposite to the adapter circuit board 2, comprising a circuit board 41, which has a plurality of front contact holes 42 respectively connected to the front terminals 331 in the front contact holes 33 of the filter module 3 and a plurality of rear contact holes 43 respectively connected to the terminals 112 in the through holes 111 of the base 11, a plurality of electronic devices 44 (including microprocessor, control chip and IC) installed in the circuit board 41, and two light emitting elements 45 provided at the front side of the circuit board 41 and respectively positioned in the front lamp holes 13 of the housing 1.

Further, the housing 1 is covered with a metal shielding shell 5, which has air vents 51 for ventilation.

During assembly process, the contact holes 22 of the adapter circuit board 2 are respectively electrically connected to the rear contact holes 32 of the filter module 3 through the rear terminals 321, and then the front contact holes 33 of the filter module 3 are respectively electrically connected to the front contact holes 42 of the control circuit module 4 through the front terminals 331, and then the adapter circuit board 2 with the filter module 3 and the control circuit module 4 are mounted in the accommodating chamber 10 of the housing 1 to force the rear contact holes 43 of the control circuit module 4 into engagement with the contact ends 1122 of the terminals 112 in the through holes 111 of the base 11 and simultaneously to force the bottom grounding contact 23 into contact with the grounding terminal 24, and then the cover plate 113 is covered on the control circuit module 4 over the rear contact holes 43 to block the contact ends 1122 of the terminals 112 and to prohibit contact of the contact ends 1122 of the terminals 112 with the metal shielding shell 5 after covering of the metal shielding shell 5 on the housing 1, and then the metal shielding shell 5 is covered on the housing 1 and connected to the grounding terminal 24.

Figure 3:
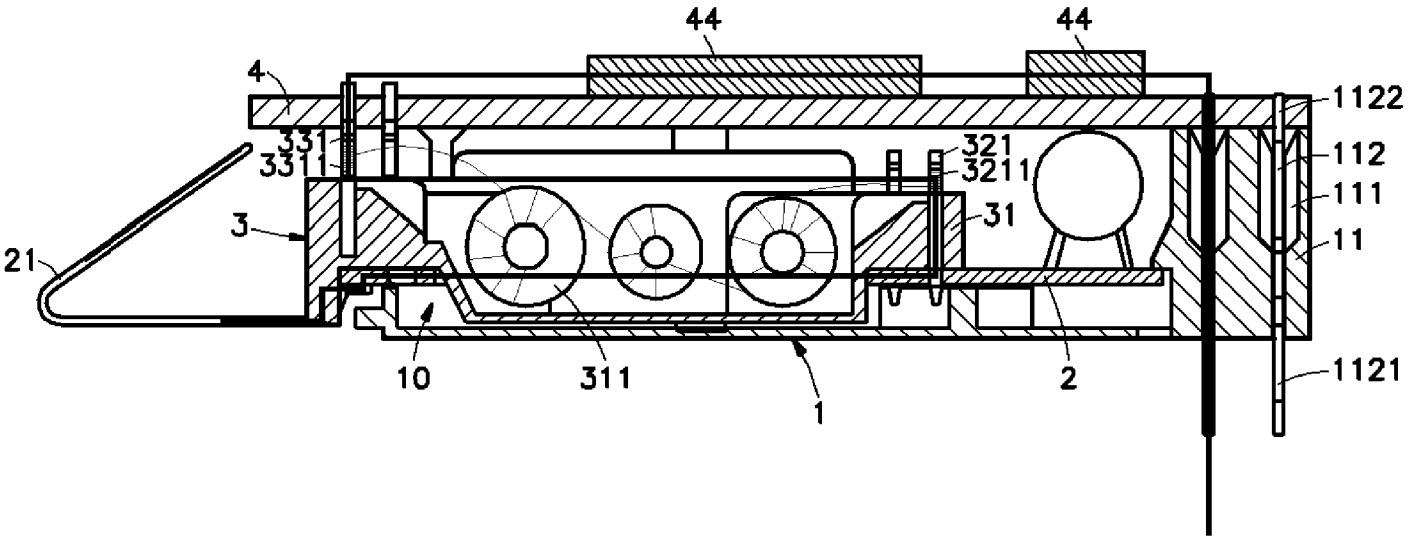
FIG. 3 is a schematic side view of the network connector according to the present invention.
Figure 4:
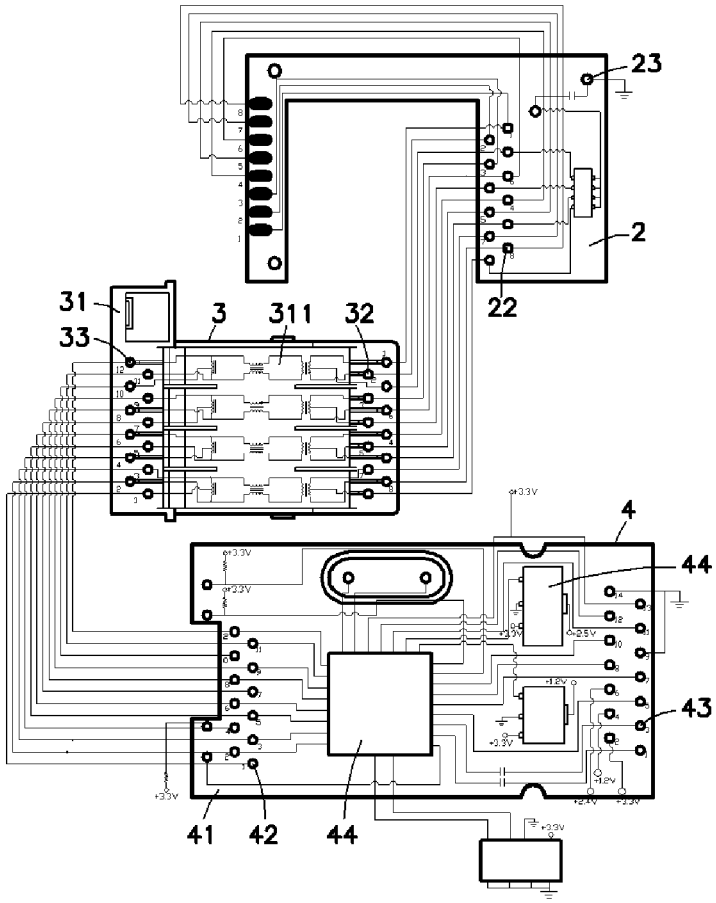
FIG. 4 is a circuit diagram of the present invention.

Referring to FIGS. 3 and 4, when the external network is connected with a connector (plug) to the curved adapter terminals 21 of the adapter circuit board 2 in the adapter slot 12 of the housing 1, the network signal is transmitted through the curved adapter terminals 21 to the contact holes 22 and then transmitted from the contact holes 22 to the rear contact holes 32 of the filter module 3 through the rear terminals 321, enabling noises to be further filtered from the network signal by the filter circuit 311. The filtered network signal is then transmitted from the filter circuit 311 to the front contact holes 33 of the filter module 3 and then to the front contact holes 42 of the control circuit module 4 through the front terminals 331, for enabling the electronic devices 44 of the control circuit module 4 to fetch data from the filtered network signal for conversion. The converted series data is then sent to the rear contact holes 43 and then the terminals 112 for output to the connected external data processing system (not shown). When the connected external data processing system outputted a series data, the series data is transmitted to the rear contact holes 43 of the control circuit module 4 through terminals 112 for converting into a corresponding network signal by the electronic devices 44 of the control circuit module 4. The network signal thus obtained is then transmitted through the front contact holes 42 of the control circuit module 4 to the front contact holes 33 of the filter module 3 through the front terminals 331, and filtered by the filter circuit 311, and then outputted through the rear contact holes 32 to the rear contact holes 22 of the adapter circuit board 2 and to the external network via the curved terminals 21. This zigzag signal transmission route greatly reduces the dimensions of the network connector. Because the network connector has the filter module 3 and the control circuit module 4 installed therein, it can simultaneously process the signal and remove noises from the signal. Further, because the metal shielding shell 5 surrounds the housing 1, the network connector provides a satisfactory EMI (electromagnetic interference) protective effect.

Referring to FIGS. 1 and 2 again, when the network connector proceeding with a signal processing and data transmission operation, the light emitting elements 45 of the control circuit module 4 are driven to flash, giving a visual signal indicative of the current operation status of the network connector. If the network connector does no work, the light emitting elements 45 of the control circuit module 4 are off. Further, during working of the electronic devices 44 of the control circuit module 4, produced heat is dissipated out of the network connector through the air vents 51 of the metal shielding shell 5, and therefore heat energy will not be accumulated in the network connector to damage the electronic devices 44.

Figure 5:
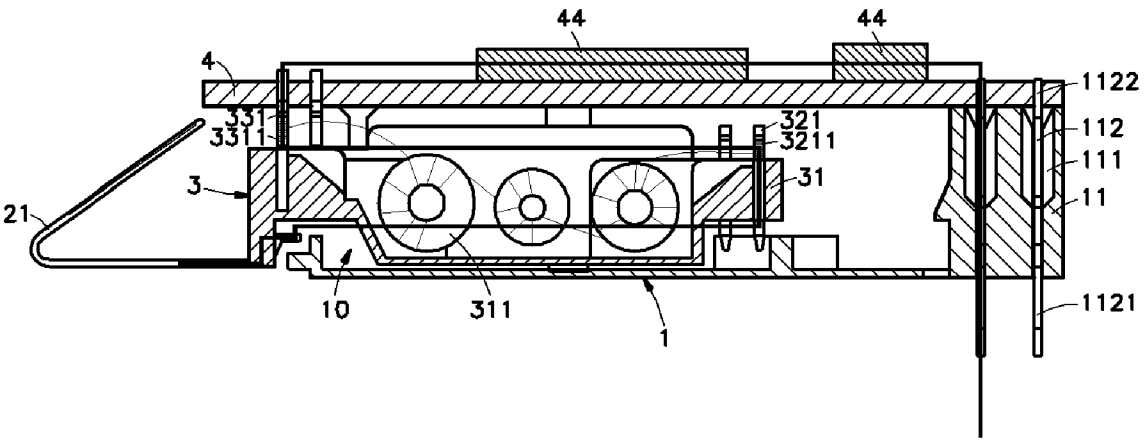
FIG. 5 is a schematic side view of an alternate form of the network connector according to the present invention.

FIG. 5 is a schematic side view of an alternate form of the network connector according to the present invention. This embodiment is substantially similar to the aforesaid first embodiment of the present invention with the exception that an adapter circuit is used and backwardly extended from the curved adapter terminals 21 and directly electrically connected to the rear terminals 321 in the rear contact holes 32 of the filter module 3 to substitute for the aforesaid adapter circuit board 2. This second embodiment achieves the same effects as the aforesaid first embodiment of the present invention.

Figure 6:
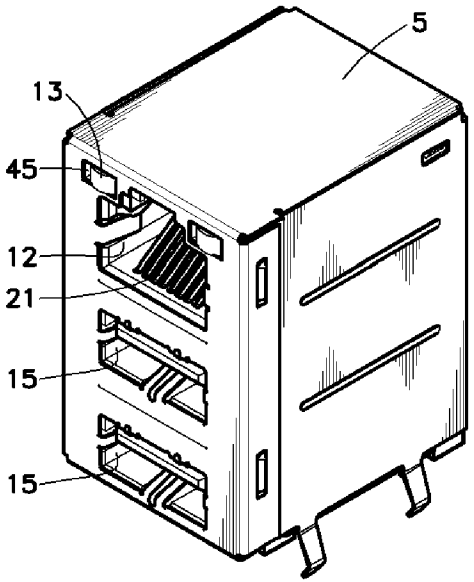
FIG. 6 is an elevational view of another alternate form of the network connector according to the present invention.
Figure 7:
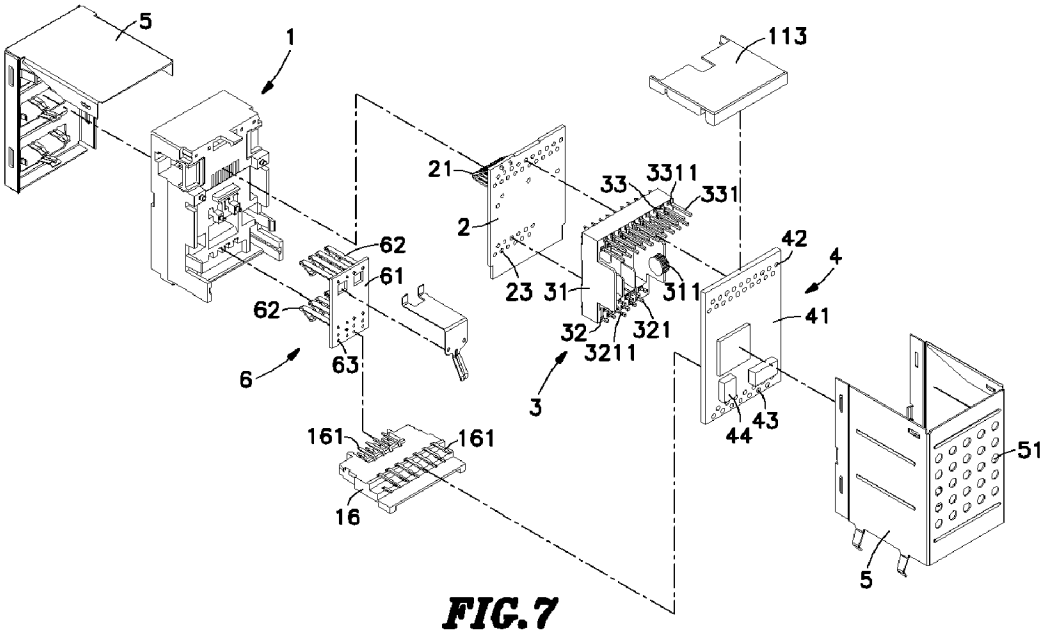
FIG. 7 is an exploded view of the network connector shown in FIG. 6.

FIGS. 6 and 7 show another alternate form of the network connector according to the present invention. This embodiment has other connector modules incorporated therein. According to this embodiment, the housing 1 has a plurality of vertically spaced connector slots 15. The adapter circuit board 2, the filter module 3 and the control circuit module 4 are mounted in the housing 1 at the rear side. This embodiment further comprises a connector module 6 corresponding to the connector slots 15, and a terminal holder 16. The connector module 6 comprises a circuit board 61, which has a plurality of contact holes 63, and a plurality of terminals 62 installed in the circuit board 61 and suspending in the connector slots 15. The terminal holder 16 is mounted in the housing 1 near the bottom side and holds a plurality of terminals 161 respectively electrically connected to the contact holes 63 of the connector module 6, the rear contact holes 43 of the control circuit module 4 and the an external circuit board (not shown). The connector module 6 can be a USB (universal serial bus) connector module or IEEE1 394 connector module. The connector slots 15 fit a USB or IEEE1 394 connector. Based on the concept of the present invention, the number of the connector slots 15 and the connector module 16 may be increased. Further, the connector module 16 can be of any of a variety of transmission specifications.

As indicated above, the network connector according to the present invention has incorporated therein a control circuit module and a filter module to simultaneously perform signal processing and filtering works, and uses a zigzag transmission route for signal transmission to reduce the dimensions of the whole assembly. This design simplifies the fabrication and the assembly process.

A prototype of network connector has been constructed with the features of FIGS. 1~7. The network connector functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A network connector comprising:

an electrically insulative housing, said electrically insulative housing comprising an accommodating chamber, a base disposed at one side of said accommodating chamber, said base having a plurality of through holes, a plurality of terminals respectively mounted in the through holes of said base and bonded to an external circuit board, a adapter slot disposed at one side of said accommodating chamber opposite to said base and adapted to receive a connector from a network;

an adapter circuit board mounted in said accommodating chamber inside said electrically insulative housing, said adapter circuit board comprising a plurality of curved adapter terminals respectively suspending in said adapter slot of said electrically insulative housing;

a filter module; and a control circuit module;

wherein said adapter circuit board comprises a plurality of contact holes near a rear side thereof; said filter module comprises a plurality of rear contact holes respectively electrically connected to the contact holes of said adapter circuit board and a plurality of front contact holes; said control circuit module comprises a plurality of front contact holes respectively electrically connected to the front contact holes of said filter module and a plurality of rear contact holes respectively electrically connected to the terminals of said electrically insulative housing.

2. The network connector as claimed in claim 1, wherein the terminals of said electrically insulative housing each have a bonding end extending out of a bottom side of said base for bonding to an external circuit board and a contact end extending out of a top side of said base and respectively connected to the rear contact holes of said control circuit module.

3. The network connector as claimed in claim 2, further comprising a cover plate covered on the rear contact holes of said control circuit module over the contact ends of the terminals of said electrically insulative housing.

4. The network connector as claimed in claim 1, further comprising at least one metal grounding spring plate respectively mounted in said adapter slot of said electrically insulative housing.

5. The network connector as claimed in claim 1, wherein said adapter circuit board comprises a bottom grounding contact; said electrically insulative housing comprises a grounding terminal suspending in said accommodating chamber and adapted to contact the bottom grounding contact of said adapter circuit board.

6. The network connector as claimed in claim 1, wherein said filter module is provided at one side of said adapter circuit board, comprising a filter holder, a filter circuit mounted in said filter holder, a plurality of rear terminals respectively mounted in the rear contact holes of said filter module and respectively electrically connected to the contact holes of said adapter circuit board, and a plurality of front terminals respectively mounted in the front contact holes of said filter module and respectively electrically connected to the front contact holes of said control circuit module.

7. The network connector as claimed in claim 6, wherein said filter circuit is comprised of a plurality of resistors, a plurality of capacitors, coils, and a plurality of filters; the front terminals and rear terminals of said filter module each have a neck respectively fastened to the coils of said filter circuit.

8. The network connector as claimed in claim 1, wherein said control circuit module is provided at one side of filter module opposite to said adapter circuit board, comprising a circuit board, a plurality of electronic devices installed in the circuit board of said control circuit module, and at least one light emitting element installed in a front side of the circuit board of said control circuit module and positioned in a front side of said electrically insulative housing; said electrically insulative housing comprises at least one front lamp hole in a front side thereof adjacent to said adapter slot for accommodating the at least one light emitting element of said control circuit module.

9. The network connector as claimed in claim 8, wherein said electronic devices of said control circuit module include a microprocessor, control chip and IC.

10. The network connector as claimed in claim 1, further comprising a metal shielding shell surrounding said electrically insulative housing, and said metal shielding shell having a plurality of air vents.

11. A network connector comprising:

an electrically insulative housing, said electrically insulative housing comprising an accommodating chamber, a base disposed at one side of said accommodating chamber, said base having a plurality of through holes, a plurality of terminals respectively mounted in the through holes of said base and bonded to an external circuit board, a adapter slot disposed at one side of said accommodating chamber opposite to said base and adapted to receive a connector from a network;

a plurality of curved adapter terminals respectively suspending in said adapter slot of said electrically insulative housing for the contact of an electric connector inserted into said adapter slot;

an adapter circuit mounted in said accommodating chamber inside said electrically insulative housing;

a filter module; and a control circuit module;

wherein said adapter circuit is electrically extended backwards from said curved adapter terminals and electrically connected to said filter module; said filter module comprises a plurality of rear contact holes respectively electrically connected to said adapter circuit and a plurality of front contact holes; said control circuit module comprises a plurality of front contact holes respectively electrically connected to the front contact holes of said filter module and a plurality of rear contact holes respectively electrically connected to the terminals of said electrically insulative housing.

12. The network connector as claimed in claim 11, wherein the terminals of said electrically insulative housing each have a bonding end extending out of a bottom side of said base for bonding to an external circuit board and a contact end extending out of a top side of said base and respectively connected to the rear contact holes of said control circuit module.

13. The network connector as claimed in claim 12, further comprising a cover plate covered on the rear contact holes of said control circuit module over the contact ends of the terminals of said electrically insulative housing.

14. The network connector as claimed in claim 11, further comprising at least one metal grounding spring plate respectively mounted in said adapter slot of said electrically insulative housing.

15. The network connector as claimed in claim 11, wherein said filter module is provided at one side of said adapter circuit, comprising a filter holder, a filter circuit mounted in said filter holder, a plurality of rear terminals respectively mounted in the rear contact holes of said filter module and respectively electrically connected to said adapter circuit, and a plurality of front terminals respectively mounted in the front contact holes of said filter module and respectively electrically connected to the front contact holes of said control circuit module.

16. The network connector as claimed in claim 15, wherein said filter circuit is comprised of a plurality of resistors, a plurality of capacitors, coils, and a plurality of filters; the front terminals and rear terminals of said filter module each have a neck respectively fastened to the coils of said filter circuit.

17. The network connector as claimed in claim 11, wherein said control circuit module is provided at one side of filter module opposite to said adapter circuit, comprising a circuit board, a plurality of electronic devices installed in the circuit board of said control circuit module, and at least one light emitting element installed in a front side of the circuit board of said control circuit module and positioned in a front side of said electrically insulative housing;

said electrically insulative housing comprises at least one front lamp hole in a front side thereof adjacent to said adapter slot for accommodating the at least one light emitting element of said control circuit module.

18. The network connector as claimed in claim 17, wherein said electronic devices of said control circuit module include a microprocessor, control chip and IC.

19. The network connector as claimed in claim 11, further comprising a metal shielding shell surrounding said electrically insulative housing, and said metal shielding shell having a plurality of air vents.

* * * * *